US005153553A

United States Patent [19]

Ruehl et al.

[11] Patent Number: 5,153,553

[45] Date of Patent: Oct. 6, 1992

[54] FUSE STRUCTURE

[75] Inventors: William E. Ruehl, Elgin; Bjarne Frederiksen, Villa Park; John Alice, Arlington Heights; E. Grant Swick, Bartlett, all of Ill.

[73] Assignee: Illinois Tool Works, Inc., Glenview, Ill.

[21] Appl. No.: 792,153

[22] Filed: Nov. 8, 1991

[51] Int. Cl.[5] ..... H01H 85/38; H01H 85/04

[52] U.S. Cl. ..... 337/273; 337/282; 337/290

[58] Field of Search ..... 337/158-166, 337/273-282, 290-292, 296, 297

[56] References Cited

U.S. PATENT DOCUMENTS

| | | | |
|---|---|---|---|
| 1,374,246 | 4/1921 | Snow . | |
| 1,377,398 | 5/1921 | Conrad . | |
| 1,945,539 | 2/1934 | Smith . | |
| 2,245,346 | 6/1941 | Klein . | |
| 3,333,076 | 7/1967 | Jacks et al. | 337/166 |
| 3,581,262 | 5/1971 | Badinter et al. | 337/290 |
| 3,801,947 | 4/1974 | Blewitt et al. | 337/228 |
| 4,308,515 | 12/1981 | Rooney et al. | 337/162 |
| 4,503,415 | 3/1985 | Rooney et al. | 337/160 |
| 4,855,705 | 8/1989 | Narancic et al. | 337/246 |
| 5,027,101 | 6/1991 | Morrill, Jr. | 337/297 |

*Primary Examiner*—Harold Broome

*Attorney, Agent, or Firm*—Trexler, Bushnell, Giangiorgi & Blackstone, Ltd.

[57] ABSTRACT

A fuse having a rated current for protecting electric or electronic circuitry comprises a body having a blow chamber. A fusible element is contained within the body and extends through the blow chamber. A contact is disposed on the body electrically connected to the fusible element for making an electrical connection between the fuse and the circuitry. The blow chamber is sealed around the fusible element so that thermal energy in the fusible element can increase within the blow chamber for causing the element to open when an elevated current is applied to the element. The blow chamber is sufficiently sealed around the element for retaining a pressure created therewithin by vaporization of a portion of the element; that pressure is sufficient to cause an arc produced by fusion of the element to extinguish. The body is of sufficient strength to contain the pressure within the blow chamber for allowing the fuse to fail gracefully. Thermal conductive cement is disposed about the entire fusible element without the blow chamber for preventing the fusible element from opening without the blow chamber before opening within the blow chamber.

23 Claims, 1 Drawing Sheet

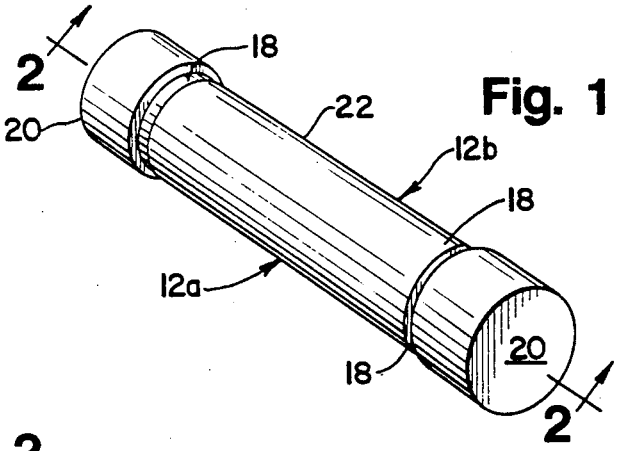
Fig. 1
Fig. 2
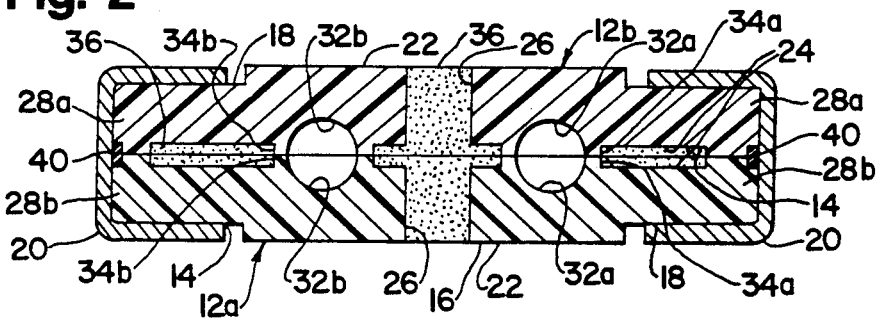
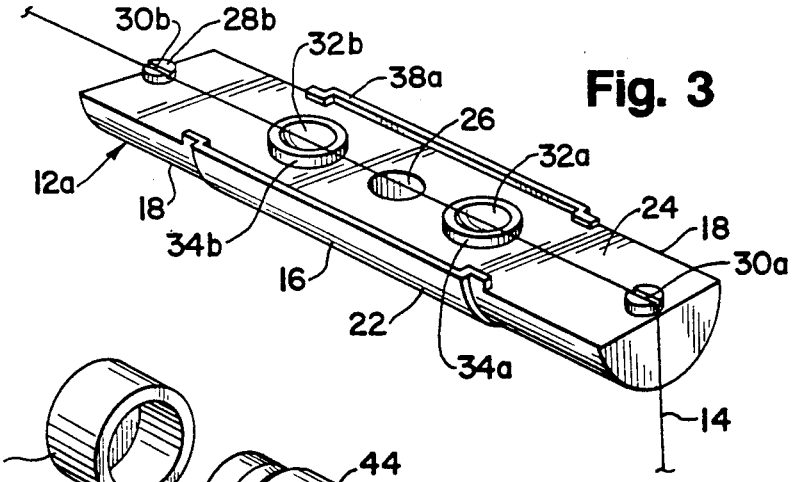
Fig. 3
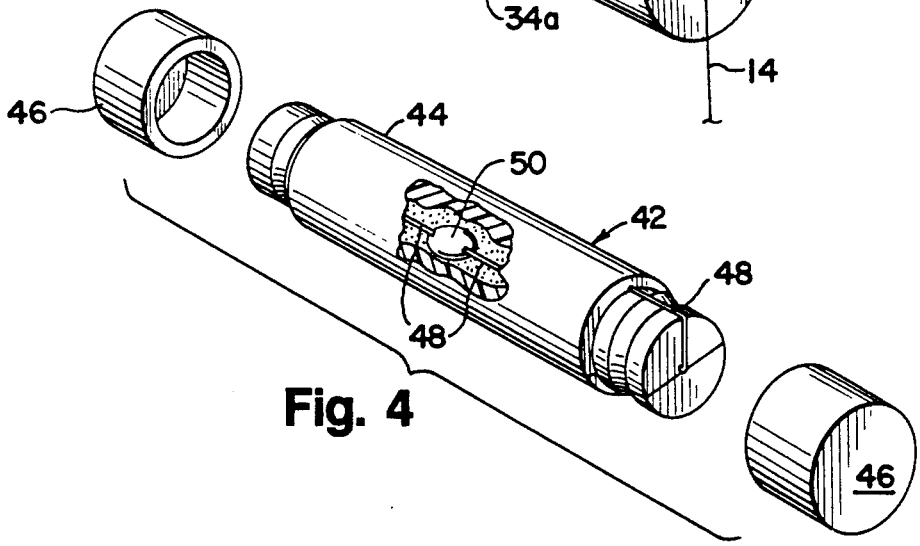
Fig. 4

FUSE STRUCTURE

BACKGROUND AND SUMMARY OF THE INVENTION

The present invention relates generally to a new and useful fuse structure having unique functional characteristics and capabilities.

The use of telecommunications circuits and networks containing those circuits is increasing significantly nationwide. Facsimile machines and computers, as well as other telecommunications devices, have become quite popular, thereby increasing consumer use of telecommunications circuits. In order to protect those consumers and their equipment from some of the dangers inherent in such circuits, regulatory agencies and testing laboratories, for example, have promulgated certain specifications for telecommunications circuits and elements thereof. One such element is a fuse.

Underwriters Laboratories has formulated a number of specifications for fuses used in telecommunications, as well as other circuits. One such specification states that a fuse must "fail gracefully" when it is subjected to a variety of current levels (i.e. amps) at 600 volts of alternating current (hereinafter "AC"). To fail gracefully, the fuse must open without fire, explosion, projectile production, or the like. The precise current level depends upon the type of fuse (e.g. 10,000 amps for a primary line fuse, 60 to 350 amps for a primary instrument fuse), but the industry has generally agreed that the appropriate current rating is 0.350 amps for all relevant telecommunications fuses. Additionally, a 22 gauge wire is in series with the fuse under the above-described conditions, and that wire must not fail under those conditions. Also, relating to sneak fuses, a sneak fuse must fail gracefully at 40, 7, and 2.2 amps at 600 volts AC. Additionally, the sneak fuse must protect a 1.6 amp slow-blow fuse connected in series with the sneak fuse. Thus, the 1.6 amp slow-blow fuse must be protected, under the above-specified conditions, from failure by the sneak fuse.

Another specification states that the fuse must open within 210 seconds of application of a current which is 150 percent of its rated current, which is 0.350 amps. Thus, to meet this second specification, the fuse must fail within a maximum of 210 seconds after application of a 0.525 amp current thereto. Yet another UL specification demands that the fuse carry its rated current for four hours without opening. Additionally, AT & T has a further specification which mandates that the fuse fail gracefully when subjected to a 6 amp current at 600 volts direct current (hereinafter "DC").

Construction of a single fuse to meet only one of these specifications, or even any two of the above-listed specifications, is relatively easy. However, none of the prior art fuses are singly able to meet any three of the specifications, let alone all four.

For instance, a fuse consisting of a wire filament embedded in a solid inorganic cement can carry a current of 0.350 amps for four hours, and can fail gracefully under the conditions of the first-mentioned UL specification. However, the fuse will not open within 210 seconds after application of a 0.525 amp current thereto because the fusible element therein will not reach an appropriate temperature for fusion. Worse yet, the entire fuse can become quite hot, often hot enough to melt a plastic casing in which the fuse may be mounted. This is unacceptable not only because the safety of telecommunications equipment, such as computers and the like, can be compromised, but, more importantly, because the safety of the human consumer may be compromised.

The new fuse structure, constructed according to the teachings of the present invention, is intended to solve some, if not all, of the problems presented by the corresponding fuses of the prior art. The fuse of the invention can also be employed in electric or electronic circuits other than those used in telecommunications.

OBJECTS AND SUMMARY OF THE INVENTION

A general object of the present invention is to provide a new fuse structure having unique functional characteristics and capabilities.

A more specific object of the invention is to provide a new single fuse structure that meets at least three or four of the above-described fuse specifications which cannot be met by any other, currently available, single fuse.

Another object of the present invention is to provide a new fuse structure which fails gracefully when subjected to 600 volts at 10,000 amps and to 600 volts DC at 6 amps, fails within 210 seconds after application of a current which is 150 percent of its current rating, and which carries its rated current for four hours without failing.

An additional object of the invention is to provide a new fuse structure which utilizes, in part, high pressures generated by a vaporizing fuse element to quench an electric arc produced within the fuse.

A further object of the present invention is to provide a new fuse structure having sufficient structural integrity to contain pressures sufficient to quench electrical arcs.

Another object of the invention is to provide a new fuse structure having means for transferring thermal energy from a body to contacts disposed thereon for dissipation of the energy and cooling of the fuse.

An additional object of the present invention is to provide a new fuse structure which eliminates the need for a reinforcing exterior shell.

A further object of the invention is to provide a new fuse structure having a thermal conductivity differential of a portion surrounding a fusible element so that thermal energy is appropriately dissipated without sacrificing the structural integrity.

Another object of the present invention is to provide a new fuse structure capable of quenching electrical arcs therein by photon emission therefrom.

An additional object of the invention is to provide a new fuse structure whose elements have selectively varying thermal conductivity.

A further object of the present invention is to provide a new fuse structure which meets at least all three above-mentioned Underwriters Laboratories specifications for fuses in telecommunications circuits.

Yet another object of the invention is to provide a new fuse structure which fails gracefully at 40, 7, and 2.2 amps at 600 volts AC, and which protects a 1.6 amp slow-blow fuse connected in series therewith from failure under the above-stated conditions.

A fuse having a rated current for protecting electric or electronic circuitry comprises a body having a blow chamber. A fusible element is contained within the body and extends through the blow chamber. A contact is disposed on the body electrically connected to the fusible element for making an electrical connection between the fuse and the circuitry. The blow chamber is sealed around the fusible element so that thermal energy in the fusible element can increase within the blow chamber for causing the element to open when an elevated current is applied to the element. The blow chamber is sufficiently sealed around the element for retaining a pressure created therewithin by vaporization of part of the element; that pressure is sufficient to cause an arc produced by fusion of the element to extinguish. The body is of sufficient strength to contain the pressure within the blow chamber for allowing the fuse to fail gracefully. Thermal conductive cement is disposed about the entire fusible element without the blow chamber for preventing the fusible element from opening without the blow chamber before opening within the blow chamber.

BRIEF DESCRIPTION OF THE DRAWINGS

The organization and manner of the structure and operation of the invention, together with further objects and advantages thereof, may best be understood by reference to the following description taken in connection with the accompanying drawings, wherein like reference numerals identify like elements in which:

FIG. 1 is a perspective view of a unique fuse structure, constructed according to the teachings of the present invention, and capable of meeting at least all four of the above-discussed specifications;

FIG. 2 is a sectional view, taken along line 2—2 of FIG. 1, illustrating the unique construction of the fuse structure;

FIG. 3 is a perspective view of one half body portion forming the fuse of FIGS. 1 and 2, bearing a fusible element; and FIG. 4 is a partially exploded perspective view of an alternative embodiment of the fuse structure of the invention, with a portion thereof being broken away to reveal the uniquely constructed fusible element and blow chamber disposed therein.

DETAILED DESCRIPTION OF THE PREFERRED EMBODIMENT

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

With reference initially to FIGS. 1, 2, and 3, the unique structure of the fuse 10, constructed according to the teachings of the present invention, will be discussed. In most general form, the fuse 10 comprises a two part laminated plastic body joined by an adhesive inorganic cement.

The fuse 10 generally comprises a pair of joinable half body portions 12*a* and 12*b* which, when appropriately joined, as will be discussed hereinafter, encompass a fusible element 14. In the particular construction of the fuse 10 illustrated in FIGS. 1 through 3, the half body portions 12*a* and 12*b* are identical. This facilitates non-handed construction of the fuse 10. However, it is to be noted that the body portions 12*a* and 12*b* can be constructed differently without departing from the scope of the invention. Also, while the fuse 10 is illustrated as having a substantially cylindrical external configuration, other external configurations can also be used, for example, various polygonal cross sectional configurations.

The particular structure of the body portions 12*a* and 12*b*, combined with the fusible element 14 renders the fuse 10 capable of meeting all four of the above-discussed specifications, as will be discussed further hereinbelow. The half body portions 12*a* and 12*b* are preferably composed of a liquid crystal polymer, steatite, alumina, sintered glass, a high temperature polymer, or the like, which facilitates conduction of thermal energy by the body portions 12*a* and 12*b*.

The body portions 12*a* and 12*b* each have a relatively enlarged section 16 and two relatively reduced sections 18 on opposite ends of the enlarged section 16. Thusly, the reduced sections 18 flank and define opposing ends of the enlarged section 16. The reduced sections 18 are of reduced dimensions as compared with corresponding dimensions of the enlarged section 16 so that end caps or contacts 20 can be disposed on the reduced sections 18 for facilitating electrical connection of the fuse 10 to a circuit.

The body portions 12*a* and 12*b* have a top or outer surface 22, illustrated in FIGS. 1 through 3, and a bottom or inner surface 24, visible in FIGS. 2 and 3. The outer surface 22 is substantially curved, due to the predetermined substantially cylindrical external configuration of the fuse 10, while the inner surface 24 is substantially planar. A transverse bore 26 extends through each body portion 12*a* and 12*b* from their outer surfaces 22 to their inner surfaces 24. The bore 26 allows a suitable cement, as will be disclosed later, to be injected therethrough to join the body portions 12*a* and 12*b* together while also partially encapsulating the fusible element 14. The bore 26 may be of any suitably functional configuration.

As illustrated in FIGS. 2 and 3, the body portions 12*a* and 12*b* each have certain structures disposed at their inner surfaces 24 which deviate from the generally substantially planar configuration of the surface 24. It is to be noted that, due to the preferred identical constructions of both body portions 12*a* and 12*b*, these structures align with, confront, and engage each other when the body portions 12*a* and 12*b* are properly aligned and joined to form the fuse 10.

Specifically, pins 28*a* and 28*b* project substantially perpendicularly away from the surface 24 of each body portion 12*a* and 12*b* at a location centrally adjacent an end of each reduced section 18 opposite to the end thereof connected to the enlarged section 16. The pins 28*a* and 28*b* generally have a substantially cylindrical configuration. When the body portions 12*a* and 12*b* are properly aligned and joined, the pins 28*a* and 28*b* on body portion 12*a* contact the pins 28*a* and 28*b* on body portion 12*b*, respectively.

The pins 28*a* and 28*b* have substantially V-shaped slots 30*a* and 30*b*, respectively, in top portions thereof opposite to the bottom portions or ends thereof defined by the surface 24. The slots 30*a* and 30*b* extend along the top portions of the pins 28*a* and 28*b* in a direction parallel to a longitudinal axis of elongation of the body portions 12*a* and 12*b*. The slots 30*a* and 30*b* are dimensioned and configured for holding and guiding the fusible element 14 therebetween parallel to the axis of elongation.

Additionally, because the pins 28*a* and 28*b* are located centrally on opposite ends of the body portions 12*a* and 12*b*, the fusible element 14 is also located centrally along the entire length of the body portions 12*a* and 12*b*. This disposition of the fusible element 14 assists in preventing damage to the element 14, and also allows for more uniform thermal energy transfer from the element 14 to the surrounding structure of the fuse 10, as will be discussed further hereinafter.

The contacts 20 clasp the element 14, and hold the element taught across the blow chambers 32*a* and 32*b*. By applying sufficient tension to the fusible element 14 to keep the element 14 taught or straight, and maintaining that sufficient amount of tension or "taughtness" in the completed fuse 10, the electrical resistance along the length of the fusible element 14 does not vary considerably, but remains substantially uniform, thereby facilitating appropriate and proper functionality of the fuse 10, as will be discussed later.

The bore 26 of each body portion 12*a* and 12*b* is located approximately at a midpoint of a longitudinal midline of the body portions 12*a* and 12*b* extending from and linearly with the slot 30*a* in the pin 28*a* to the slot 30*b* in the pin 28*b*. In this manner, cement injected through the bore 26 will be encouraged to flow evenly between the aligned opposing surfaces 24 of the body portions 12*a* and 12*b* and thereby adhesively join the body portions 12*a* and 12*b*, as will be described below.

Preferably, blow chambers 32*a* and 32*b* recess into the body portions 12*a* and 12*b* from the surface 24. These blow chambers 32*a* and 32*b* are filled with air, wax, hot melt glue, or other suitably thermal insulating material. The illustrated embodiment shows two blow chambers 32*a* and 32*b*, however, it is to be carefully noted that one or more blow chambers may be utilized without departing from the scope of the present invention. As will be discussed in greater detail hereinbelow, the blow chambers 32*a* and 32*b* function to define individual effective fuses electrically connected in series contained within the fuse 10. Thus, the number of blow chambers utilized in a particular embodiment of the invention is discretionary, and can be adjusted to meet the requirements of a specific employment. But, it is to be noted that the greater the number of blow chambers, the greater the insurance of safety to a consumer and his equipment.

The blow chambers 32*a* and 32*b* are located adjacent diametrically opposed sides of the bore 26 such that a centerpoint of each blow chamber 32*a* and 32*b* projects onto the longitudinal midline of the body portions 12*a* and 12*b*. Thus, the centers of the bore 26, the slots 30*a* and 30*b*, and the blow chambers 32*a* and 32*b* are all contained within or project upon the same longitudinal midline, or a plane defined thereby perpendicular to a plane defined by the surface 24 of the body portions 12*a* and 12*b*. The degree by which the blow chambers 32*a* and 32*b* recess into the body portions 12*a* and 12*b* from the surface 24 towards the surface 22 is predetermined and chosen to maximize the operation of the fuse 10, as will be further discussed later.

As shown in FIG. 3, a peripheral wall 34*a* and 34*b* extends substantially perpendicularly from the surface 24 of each body portion 12*a* and 12*b* around a periphery defined by the blow chambers 32*a* and 32*b*, respectively. The walls 34*a* and 34*b* form boundaries of the blow chambers 32*a* and 32*b*. The walls 34*a* and 34*b* extend from the surface 24 a certain predetermined distance equal to the distance the pins 28*a* and 28*b* extend from the surface 24. In this manner, when the body portions 12*a* and 12*b* are properly aligned and joined together to form the fuse 10, the pins 28*a* and 28*b* and the walls 34*a* and 34*b* on the body portion 12*a* will contact the pins 28*a* and 28*b* and the walls 34*a* and 34*b*, respectively, on body portion 12*b*.

When the body portions 12*a* and 12*b* are joined, the fusible element 14 is sandwiched between the contacting walls 34*a* and 34*b* of the opposing body portions 12*a* and 12*b*. The fusible element 14 is preferably 0.001630 of an inch in diameter comprising a 0.0015 inch diameter nickel-iron core being approximately forty-two percent nickel. In a preferred construction, this core is electroplated, first with approximately a 0.000030 inch thick coating of copper, and second with a 0.000100 inch thick coating of tin. Other compositions of the element 14 are also possible within the functional parameters set forth hereinbelow.

Due to the thinness of the fusible element 14, the walls 34*a* and 34*b* of each body portion 12*a* and 12*b* form a seal around the blow chambers 32*a* and 32*b* when the body portions 12*a* and 12*b* are joined. The annular walls 34*a* and 34*b* also provide dams to prevent cement 36 from entering the blow chambers 32*a* and 32*b*, as shown in FIG. 4, and as described below. The seal formed by the walls 34*a* and 34*b* of the opposing body portions 12*a* and 12*b* and the cement 36 also prevents, at least to a sufficient degree, pressure loss from the blow chambers 32*a* and 32*b* when the fuse 10 fails in operation. The pressure retained in the blow chambers 32*a* and 32*b* facilitates proper functionality of the fuse 10, as will be described in detail later.

Additionally, due to the relative thermal conductivity of the material comprising the portions 12*a* and 12*b* as compared to the cement 36, the walls 34*a* and 34*b* provide a degree of thermal insulation to the blow chambers 32*a* and 32*b*, thereby assisting in reducing the rate of thermal energy transfer from the blow chambers 32*a* and 32*b* and the air contained therein to the cement 36. It is to be noted that the walls 34*a* and 34*b* can be configured to key into each other so as to further increase the effectiveness of the seal.

The body portions 12*a* and 12*b* have further means, in the form of dams 38*a* and 38*b*, for restricting flow of cement 36. The dams 38*a* and 38*b*, illustrated in FIGS. 1 and 3, project from the surface 24 adjacent the juncture between the surface 22 and the surface 24 a certain distance equal to the distance extended by the pins 28*a* and 28*b* and the walls 34*a* and 34*b*. Thus, the dams 38*a* and 38*b* on the body portion 12*a* contact the dams 38*a* and 38*b* on the body portion 12*b* when the body portions 12*a* and 12*b* are properly aligned and joined.

The dams 38*a* and 38*b* preferably extend substantially perpendicularly from the surface 24 on opposite sides of the body portions 12*a* and 12*b*. The dams 38*a* and 38*b* flank the longitudinal midlines of the body portions 12*a* and 12*b*, as well as the bore 26, the blow chambers 32*a* and 32*b*, and the annular walls or dams 34*a* and 34*b*. The dams 38*a* and 38*b* extend a certain distance along the peripheral lengths of the body portions 12*a* and 12*b* adjacent the juncture between the surfaces 22 and 24. Specifically, the dams 38*a* and 38*b* extend along the entire peripheral length of the enlarged section 16, while extending only slightly along the peripheral length of the reduced sections 18 adjacent the enlarged section 16. It is not necessary for the dams 38*a* and 38*b* to extend along the entire length of the reduced sections 18, because the contacts 20 will function as means for restricting cement 36 flow at this location. Thus, the cement 36 can flow to and adhesively contact the contacts 20, thereby adhesively joining the same to the adhesively joined body portions 12*a* and 12*b*.

With the configuration of the body portions 12*a* and 12*b* being disclosed, the construction of the fuse 10 from the body portions 12*a* and 12*b* will now be discussed. It is to be noted that, in the following discussion, further specifications for the above-discussed elements will become apparent.

To construct the fuse 10, shown in FIGS. 1 and 2, two body portions 12*a* and 12*b* are chosen. Due to the identical construction of the body portions 12*a* and 12*b*, any two body portions 12*a* and 12*b* will do. This is non-handed construction.

Now, the fusible element 14 is applied to one of the body portions 12*a* and 12*b*. The length of the fusible element 14 is predetermined such that the element 14 can extend across the length of the body portion and wrapped around opposite ends thereof for subsequent connection to the end caps or contacts 20, as illustrated in FIG. 2.

During assembly, the element 14 is held taught, and while taught, is clamped between opposing body portions 12*a* and 12*b* sufficiently to maintain the element 14 taught. This assists in assuring constant resistance along the length of the fusible element 14, as discussed above. The free ends of the element 14 beyond the pins 28*a* and 28*b* are respectively bent over the body portion 12*a* so that the element 14 executes the above-detailed path along the body portion 12*a*.

With the element 14 being held taught along the body portion 12*a*, the body portion 12*b* can be properly joined to the body portion 12*a*. The body portion 12*b* is appropriately aligned with the body portion 12*a* so that corresponding structures on each portion 12*a* and 12*b* contact and engage each other. Notably, when this engagement occurs, the walls 34*a* and 34*b* on the body portion 12*a* sealingly contact the walls 34*a* and 34*b* on the portion 12*b*. The element 14 is sealingly sandwiched between these walls 34*a* and 34*b* such that the blow chambers 32*a* and 32*b* on each portion 12*a* and 12*b* are sealed from ambient contaminants. A certain, predetermined volume of air, or other suitable thermal insulating substance, is thusly trapped in the blow chambers 32*a* and 32*b* surrounding the element 14 disposed therein. The significance of this air will become more clear hereinafter. The pins 28*a* and 28*b* on each portion 12*a* and 12*b* cooperate to insure that the element 14 is securely held within the slots 30*a* and 30*b* while taught, as discussed above, and that the element 14 runs substantially along a longitudinal midline of the combined body portions 12*a* and 12*b*.

The contacts 20, composed of a suitable electrically conducting material, such as a metal and the like, are now applied to the combined portions 12*a* and 12*b*. The contacts 20, as illustrated, are substantially cylindrical in shape, having a closed end and an open end for accepting the reduced sections 18 of the joined portions 12*a* and 12*b*. When the contacts 20 are applied to the joined portions 12*a* and 12*b*, the contacts 20 assist in holding the portions 12*a* and 12*b* together. If the cement 36 does not have adhesive properties sufficient to adhesively bond the body portions 12*a* and 12*b* then the contacts 20 can be constructed to provide the necessary structural integrity to the joined body portions 12*a* and 12*b* to insure graceful failure of the fuse 10.

Also, at this point, an electrically conducting connection is formed between the element 14 and the contacts 20. Specifically, a drop or bead 40 of electrically conducting, preferably liquid, solder is placed within the contacts 20 prior to application to the joined body portions 12*a* and 12*b*, and is retained within the contacts 20 because the contacts 20 are substantially cup-like in configuration. When the contacts 20 are applied to the joined body portions 12*a* and 12*b*, the bead 40 connects the element 14 with the contacts 20. A soldering iron, or other suitable tool, can now be brought adjacent an outer surface of the closed ends of the contacts 20, thereby forming a soldered connection between the element 14 and the contacts 20 by means of the bead 40, as shown in FIG. 2. It is to be noted that the electrical connection between the element 14 and the contacts 20 is formed before application of the cement 36. This insures that the cement 36 will not compromise electrical connection of the element 14 with the contacts 20.

The joined portions 12*a* and 12*b* bearing the contacts 20 are now ready for application of the cement 36. The cement 36 is inorganic, and has certain thermal conductive properties relative to the like properties of the material comprising the body portions 12*a* and 12*b*, as will be discussed further herein. The cement 36 can be selected from a number of materials, such as a mixture of zirconium oxide or silica powder and a plasticizer, a mixture of silica powder and sodium silicate, various inorganic electrical cements, a mixture of aluminum oxide and sodium silicate, a mixture of magnesium oxide and sodium silicate, an inorganic filler and a bonding agent (preferably in liquid form), and the like. An inorganic pigment may be added to the cement 36 to provide an identifying characteristic to the fuse 10.

To apply the cement 36, the bore 26 in either body portion 12*a* or 12*b* is plugged adjacent the outer surface 22 by suitable means, not shown, for preventing cement 36 from flowing therethrough. A cement bearing nozzle, also not shown, is operatively connected with the unplugged bore 26 adjacent the outer surface 22. The cement 36 is injected through the nozzle into the unplugged bore 26. The cement 36 flows towards the plugged bore 26, thereby filling it.

As the cement 36 continues to flow through the unplugged bore 26, the cement 36 flows between the opposing surfaces 24 of both portions 12*a* and 12*b*. The cement 36 encounters the joined walls 34*a* and 34*b*. However, because the walls 34*a* and 34*b* are sealingly engaged, cement 36 is prevented from flowing into the blow chambers 32*a* and 32*b*. The walls 34*a* and 34*b* direct the cement 36 to flow therearound so that the entire space between the portions 12*a* and 12*b* is filled with cement 36.

The cement 36 flow continues, and the cement 36 engages the dams 38*a* and 38*b*. The dams 38*a* and 38*b* prevent the cement 36 from passing thereby towards the outer surface 22. The dams 38*a* and 38*b* also cooperate with the walls 34*a* and 34*b* to direct the cement 36 towards the pins 28*a* and 28*b*.

The cement 36 flows towards the pins 28*a* and 28*b*. However, because the dams 38*a* and 38*b* do not extend along the entire length of the reduced sections 18, the cement 36 flows out from under the adjacent opposing surfaces 24 to adhesively engage the contacts 20. Thus, the contacts 20 are adhesively joined to the joined portions 12*a* and 12*b* by the cement 36. The cement 36 flow continues until the entire space between the adjacent surfaces 24 is filled by the cement 36, as shown in FIG. 2. Notably, because the element 14 is located longitudinally centrally between and along the joined portions 12*a* and 12*b*, the element 14 is encapsulated by the cement 36 substantially throughout its entire length, excepting, of course, the segments thereof disposed within the volume defined by the blow chambers 32*a* and 32*b* and the walls 34*a* and 34*b*.

Once the joined body portions 12*a* and 12*b* and the contacts 20 are completely involved with and adhesively joined by the cement 36, the cement 36 flow is halted. The nozzle and the means for plugging the bore 26 are removed. Again, it is to be noted that, while the fuse 10 is illustrated in a specific cylindrical form, the fuse 10 may take on any desired configuration without departing from the teachings of the present invention.

With the configuration and construction of the fuse 10 being thusly disclosed, the operation thereof will now be discussed in detail. It is to be noted that the following discussion will place further specifications upon the above-described structures of the fuse 10.

When the fuse 10 is connected into a circuit, the contacts 20 are often engaged by clips or leads, not shown, for forming an electrical connection between the fuse 10 and the circuit. The clips form a relatively large mass as compared to the mass of the contacts 20, and also, at times, the fuse 10. When the fuse 10 encounters an overcurrent or overvoltage condition, as under the conditions anticipated by the four, above-discussed specifications, thermal energy is generated in the fusible element 14 along its entire length. This thermal energy can be quite substantial, and in some instances (e.g. those involved in the second UL specification: the fuse carrying rated current for four hours without opening), can reach levels sufficient to melt the body of the fuse. The cement 36 assists in preventing the thermal energy levels in the fuse 10 from reaching those fuse meltdown levels by facilitating dissipation of the thermal energy, or at least a portion thereof, from the fuse 10.

Specifically, the thermal energy generated along the relevant length of the fusible element 14 is partially transmitted to the cement 36, which encapsulates the element 14 along its entire length except for the portions thereof disposed within the walls 34*a* and 34*b*, as noted above. Also as stated above, the cement 36 is preferably composed of materials, such as a mixture of zirconium oxide or silica powder and a plasticzer, a mixture of silica powder and sodium silicate, various inorganic electrical cements, a mixture of aluminum oxide and sodium silicate, a mixture of magnesium oxide and sodium silicate, an inorganic filler and a bonding agent, and the like, having an increased thermal conductivity as compared to the thermal conductivity of the material comprising the portions 12*a* and 12*b*, namely a liquid crystal polymer, a high temperature polymer, or the like. This selective relative thermal conductivity of the portions 12*a* and 12*b* as compared to the cement 36 facilitates dissipation of the generated thermal energy, thereby preventing meltdown of the fuse 10 under the circumstances of the UL and other specifications.

The relatively increased thermal conductivity of the cement 36 allows it to wick thermal energy away from the fusible element 14, thereby cooling the element 14 somewhat. This cooling of the element 14 by the thermal conductive action of the cement 36 allows the fuse 10 to carry its rated current (0.350 amps) for a period of at least four hours without opening. Without this thermal conductive cooling process, the thermal energy of the fuse 10 may build up to levels sufficient for melting the element 14, thereby causing the fuse 10 to open prematurely.

The relative thermal conductivity of the portions 12*a* and 12*b* as compared to the cement 36 also insures that meltdown of the portions 12*a* and 12*b* will not occur. Because the material comprising the portions 12*a* and 12*b* does not conduct thermal energy as readily as the cement 36 does, thermal energy is not quickly transmitted from the cement 36 to the portions 12*a* and 12*b*, thus thermal energy does not build up readily within the portions 12*a* and 12*b*. This allows the portions 12*a* and 12*b* to remain relatively cool.

As additional insurance against meltdown, the material comprising the portions 12*a* and 12*b* can be chosen, subject to the above-discussed limitations, such that the portions 12*a* and 12*b* The intumesce or swell upon application of sufficient thermal energy. The intumescence of the portions 12*a* and 12*b* further insures that significant thermal energy is not transmitted from the portions of the pins 28*a* and 28*b* and the walls 34*a* and 34*b* directly contacting the element 14 to other segments of the portions 12*a* and 12*b* proper.

Additionally, because the cement 36 extends between and contacts both contacts 20, and because the contacts 20 are preferably composed of a substance, such as a metal, which relatively readily conducts thermal energy, thermal energy is more readily transferred from the cement 36 to the contacts 20 as compared to similar transmission from the cement 36 to the portions 12*a* and 12*b*. Thus, thermal energy is transmitted from the element 14 to the cement 36, from the cement 36 to the contacts 20, and thereafter to the clips and the circuit. In essence, the contacts 20 and the cement 36 perform like a heat sink. In this manner, the fuse 10 meets the second UL specification, and additionally remains relatively cool under the conditions presumed by that specification.

The cement 36 is also instrumental in helping the fuse 10 meet the first stated UL specification, namely that the fuse 10 fail gracefully at 600 volts AC. The adhesive properties of the cement 36 help the fuse 10 fail gracefully under the conditions of the first UL specification, as well the AT & T specification (failing gracefully at 600 volts DC).

The cement 36 is chosen to have sufficiently strong adhesive properties to hold the portions 12*a* and 12*b* together under the conditions presumed by the last-mentioned specification, thereby allowing failure of the fuse 10 without fire, explosion, projectile production or the like. More specifically, the cement 36 is sufficiently strong to resist and retain pressures generated by failure, or fusion of the fusible element 14. It is to be noted that the element 14 fails at the segment or segments thereof disposed within the walls 34*a* and 34*b* because the remainder of the element 14 is encapsulated by cement 36, which prevents buildup of thermal energy sufficient to cause failure of the element 14. This phenomenon will become more clear hereinbelow. If the cement 36 has insufficient or no adhesive properties, then sufficient structural strength can be provided to hold the portions 12*a* and 12*b* together, thereby insuring graceful failure, by sufficiently snug-fitting contacts 20 or other suitable means.

As the fuse 10 fails, the segment or segments of the element 14 within the walls 34*a* and 34*b* partially vaporize and partially melt. This phase change of the element 14 produces a rapid pressure increase within the volume bounded by the blow chambers 32*a* and 32*b* and the walls 34*a* and 34*b*. This rapid pressure increase, in other fuses, may prevent those fuses from failing gracefully, causing explosion, projectile production, and fire. However, with the fuse 10, the cement 36 adhesively holds the portions 12*a* and 12*b* together with a strength sufficient to resist separation thereof under these pressures. Thus, because the cement 36 has sufficient adhesive strength for holding the portions 12*a* and 12*b* together under the pressures generated by vaporization and meltdown of the element 14, an external reinforcing shell is not required to insure graceful failure of the fuse 10 under the conditions of the first UL specification and the AT & T specification.

The adhesive strength of the cement 36 also provides additional benefits to the fuse 10, thereby further insuring graceful failure thereof. When fuses fail under the conditions of the first UL specification and the AT & T specification, an arc is often quickly formed at the location of element failure. With the fuse 10 of the invention, this arc forms within the volume defined by the blow chambers 32*a* and 32*b* and the walls 34*a* and 34*b*. In order to insure graceful failure of the fuse 10, it is desirable to extinguish this arc quickly upon failure of the element 14. The adhesive strength of the cement 36 facilitates quick extinguishing of the arc.

Specifically, the adhesive strength of the cement 36 holds the portions 12*a* and 12*b* together sufficiently to maintain a relatively high pressure condition within the volume defined by the blow chambers 32*a* and 32*b* and the walls 34*a* and 34*b* upon failure or fusion of the element 14. As the pressure of the environment surrounding the arc increases, the voltage necessary to sustain the arc also increases. This physical phenomenon is well known to those skilled in the relevant art. Additionally, the arc radiates electromagnetically, emitting photons which decrease the energy of the arc, which energy decrease must be compensated by an increased voltage supplied to the arc in order to sustain it.

The necessary voltage increase for sustaining the arc required by the increased pressure surrounding the arc and the emission of photons by the arc proportionally increases until that necessary voltage increases beyond the available voltage supplied to the arc. Thus, the arc is extinguished due to the lack of necessary voltage, thereby insuring graceful failure of the fuse 10. This occurs in a relatively short period of time, on the order of milliseconds. It is to be noted, however, that the fuse 10 is not hermetically sealed. Thus, some of the gases and attendant pressure generated by vaporization of the element 14 may escape from the fuse 10. But, it is also to be noted that the cement 36 adhesively holds the portions 12*a* and 12*b* together sufficiently to maintain sufficient pressure within the volume encompassed by the blow chambers 32*a* and 32*b* and the walls 34*a* and 34*b* in order to quickly extinguish the arc. In this manner, the fuse 10 meets the first UL specification as well as the AT & T specification. Additionally, quick suppression of the arc allows the fuse 10 to protect a slow-blow fuse connected in series therewith. Thus, the fuse 10 meets the above-discussed specification relating to sneak fuses.

The fuse 10 also meets the second-mentioned specification, namely, the fuse 10 opens within 210 seconds of application of a current which is 150 percent of the fuse's rated current. It is to be understood that if the element 14 were completely encapsulated by the cement 36, then the fuse 10 would not meet this specification because the thermal energy generated in the element 14 would not increase to a level sufficient to cause fuse failure within the specified time period. It is with this understanding that the blow chambers 32*a* and 32*b* and the walls 34*a* and 34*b* are provided.

Specifically, the blow chambers 32*a* and 32*b* and the walls 34*a* and 34*b* insure that the segments of the element 14 disposed therein will possess thermal energy sufficient to cause failure of the element 14 within 210 seconds of application of the specified current. The blow chambers 32*a* and 32*b* and the walls 34*a* and 34*b* do this by forming a "hot spot" from which thermal energy transfer is slowed due to relative thermal conductivity relationships similar to those described above.

As stated hereinabove, the blow chambers 32*a* and 32*b* and the walls 34*a* and 34*b* trap and encompass a volume of air, or other suitable material, when the portions 12*a* and 12*b* are properly joined to form the fuse 10. The air enclosed within the volume defined by the blow chambers 32*a* and 32*b* and the walls 34*a* and 34*b* conducts thermal energy to a relatively lesser degree as compared with the material comprising the portions 12*a* and 12*b*. Thus, thermal energy generated within the volume is not conducted readily to the portions 12*a* and 12*b*, of which the blow chambers 32*a* and 32*b* and the walls 34*a* and 34*b* are a part. Just as the portions 12*a* and 12*b* have a lesser relative thermal conductivity as compared to the cement 36, so too the volume, and the materials disposed therein, have a lesser thermal conductivity as compared to the portions 12*a* and 12*b*.

These selective relative thermal conductivity relationships insure that the fuse 10 will meet the second specification. Illustrating by means of example, a current which is 150 percent of the fuse's rated current is applied to the fuse 10. Thermal energy builds up along the entire length of the element 14. The thermal energy generated in those segments of the element 14 encapsulated by the cement 36 will be transmitted to the cement 36 according to the above-disclosed process. Thus, these segments of the element 14 will not possess thermal energy of a level sufficient to cause the fuse 10 to open or fail within 210 seconds of current application.

However, the segments of the element 14 disposed within the volume defined by the blow chambers 32*a* and 32*b* and the walls 34*a* and 34*b* are surrounded by air, or another material having a relatively low thermal conductivity. Because the air does not conduct thermal energy as readily as the cement 36, thermal energy will build up in these, last-mentioned segments to a level sufficient to cause the fuse 10 to open within 210 seconds of current application. For this to occur, it is necessary, as described above, that no cement 36 be allowed to enter the volume during manufacture of the fuse 10, because this would compromise the necessary relative thermal conductivity relationships. The walls 34*a* and 34*b* prevent cement 36 from flowing into the volume, and also provide a type of thermal insulation to the volume, due to the reduced thermal conductivity of the portions 12*a* and 12*b* as compared to the thermal conductivity of the cement 36.

In this manner, the fuse 10 meets the second specification. As stated above, however, it is to be noted that, because each volume (two being illustrated in FIGS. 2 and 3) defined by the blow chambers 32*a* and 32*b* and the walls 34*a* and 34*b* separately performs the above-described function, each volume acts as a separate, effective fuse. Thus, the illustrated embodiment of the fuse 10 possesses two effective fuses. Any number of effective fuses can be disposed in the fuse 10. Accordingly, the number of effective fuses can be chosen to meet any desired specification, and to provide added protective insurance to the remainder of the circuit to which the fuse 10 is connected. Thus, the fuse 10 is a substantial improvement over the fuses of the prior art in that it is capable of meeting at least all four of the above-discussed specifications; something which, it is believed, no currently available fuse can do.

An equally functional fuse 42, illustrated in FIG. 4, is an alternative embodiment of the invention. Again, it is to be noted that while the fuse 42 is illustrated as having a substantially cylindrical external configuration, the fuse 42 may have other configurations depending upon the employment thereof.

The fuse 42 comprises a body 44, a pair of end caps or contacts 46 applied to the body 44 in common fashion, and a fusible element 48. The fusible element 48 is constructed substantially similarly to the element 14 described above. However, in this embodiment, the blow chamber is provided by at least one blow chamber or bead 50 applied to the element 48 such that the element 48 extends through the bead 50 substantially along a diameter thereof. The bead 50 functions similarly to the blow chambers 32*a* and 32*b*, and is composed of a hot melt adhesive, wax, or another substance having a relatively low thermal conductivity as compared with the thermal conductivity of the body 44. Because the bead 50 acts to provide a "hot spot" or an effective fuse in the fusible element 48, the number thereof disposed on the element 48 can be varied, just as the number of the blow chambers 32*a* and 32*b* can be varied.

To construct the fuse 42, the desired number of beads 50 is applied to the element 48 by suitable means, such as a nozzle, not shown. The bead-bearing element 48 is properly positioned in a mold, not shown, or other suitable device. The mold is of a suitable configuration for forming the desired configuration of the body 44. The proper position of the element 48 within the mold is determined so that the element 48 is located within the body 44 in a similarly central disposition as the element 14 within the combined portions 12*a* and 12*b*. This central disposition facilitates even thermal conductivity from the element 48.

The body 44 is formed of the same material as the cement 36. Thus, it is to be noted that a relative thermal conductivity relationship exists between the material comprising the body 44 and the bead 50 substantially similar to that between the material comprising the portions 12*a* and 12*b* and the cement 36, as discussed at length above. The material comprising the body 44 is suitably introduced into the mold, thereby forming the body 44 and completely encompassing a segment of the element 48 and the bead 50. Once the body 44 has solidified, the body 44 bearing the element 48 is removed from the mold. Free ends of the element 48 extend, as shown in FIG. 4, beyond ends of the body 44 in a substantially similar manner as the free ends of the element 14. The contacts 46 are positioned on and soldered to the element 48 and the body 44 in substantially the same manner as described hereinabove.

The fuse 42 functions substantially similarly to the fuse 10, as described above. The body 44 thermal conductively transmits generated thermal energy to the contacts 46 where it is dissipated. Also, the bead 50 functions similarly to the blow chambers 32*a* and 32*b*. Specifically, the bead 50 has a relatively low thermal conductivity, thus, thermal energy builds up within the bead 50 quickly, thereby enabling the fuse 42 to meet at least all four of the above-discussed specifications.

While a preferred embodiment of the present invention is shown and described, it is envisioned that those skilled in the art may devise various modifications of the present invention without departing from the spirit and scope of the appended claims. The invention is not intended to be limited by the foregoing disclosure, but only by the following appended claims. For example, the cement 36 illustrated in FIG. 2, or the body 44 of FIG. 4 can be constructed from a material which may not necessarily conduct thermal energy as described above, if it is desired to have a fuse which does not carry its rated current for four hours without opening, or which does not meet a similar specification.

The invention claimed is:

1. A fuse having a rated current for protecting electric or electronic circuitry comprising: a body having a blow chamber; a fusible element contained within the body and extending through the blow chamber, and a contact being disposed on the body and electrically connected to the fusible element for making an electrical connection between the fuse and the circuitry; means for effectively thermally insulating a portion of the fusible element within said blow chamber so that thermal energy in said fusible element portion can increase within the blow chamber for causing the element to open when an elevated current is applied to the element; means for retaining a pressure created within the blow chamber by vaporization of a portion of the element sufficiently to cause an arc produced by fusion of the element to extinguish, and for allowing the fuse to fail gracefully; and means for dissipating thermal energy located on portions of the fusible element without the blow chamber for preventing the fusible element from opening without the blow chamber before opening within the blow chamber.

2. A fuse as defined in claim 1 further comprising air disposed in and filling the blow chamber.

3. A fuse as defined in claim 1 further comprising at least one of a hot melt adhesive and wax disposed in and filling the blow chamber.

4. A fuse as defined in claim 1 wherein the body is composed of a material having a relatively low thermal conductivity as compared to a thermal conductivity of a material comprising the means for dissipating thermal energy.

5. A fuse as defined in claim 4 wherein the material comprising the body is selected from a group comprising a liquid crystal polymer, steatite, alumina, sintered glass, and a high temperature polymer.

6. A fuse as defined in claim 4 wherein the material comprising the means for dissipating thermal energy is selected from a group comprising a mixture of zirconium oxide and a plasticizer, a mixture of silica powder and a plasticizer, a mixture of silica powder and sodium silicate, an inorganic cement, a mixture of aluminum oxide and sodium silicate, a mixture of magnesium oxide and sodium silicate, and an inorganic filler mixed with a bonding agent.

7. A fuse as defined in claim 1 wherein the means for dissipating thermal energy thermally conductively connects the contact with the fusible element so that thermal energy generated in the fusible element will be transferred therefrom to the means, from the means to the contact, and from the contact to the circuitry, thereby maintaining a level of thermal energy of the body below a predetermined level.

8. A fuse having a rated current for protecting electric or electronic circuitry comprising: a body having a blow chamber; a fusible element contained within the body and extending through the blow chamber, and a contact disposed on the body and electrically connected to the fusible element for making an electrical connection between the fuse and the circuitry; the blow chamber effectively thermally insulating a portion of the fusible element therein so that thermal energy in said fusible element portion can increase within the blow chamber for causing the element to open when an elevated current is applied to the element; the blow chamber retaining a pressure created therewithin by vaporization of a portion of the element sufficiently to cause an arc produced by fusion of the element to extinguish; means for dissipating thermal energy located on portions of the fusible element without the blow chamber for preventing the fusible element from opening without the blow chamber before opening within the blow chamber; the body comprising a plurality of joined body portions having opposing surfaces; a blow chamber portion disposed in each body portion for forming the blow chamber; confronting walls being disposed around the blow chamber portions extending from said surfaces; the fusible element being sandwiched between the walls when the body portions are joined; and the body portions being joined with sufficient strength for allowing the fuse to fail gracefully at the pressure created within the blow chamber by fusion of the element at a predetermined voltage and an elevated current.

9. A fuse as defined in claim 8 wherein the body portions are adhesively joined by the means for dissipating thermal energy; the body portions having a thermal conductivity relatively lower than a thermal conductivity of the means; and the means thermally conductively connecting the fusible element to the contact for maintaining a level of thermal energy of the body joined portions below a predetermined level.

10. A fuse as defined in claim 9 wherein at least one of the body portions has a dam projecting from at least one of its surfaces for directing the means towards the contact for insuring thermal conductive contact therebetween.

11. A fuse as defined in claim 8 wherein the body portions have bores therein for facilitating injection of the means.

12. A fuse as defined in claim 1 wherein the body has pins disposed adjacent opposite ends of the body; the pins having slots therein for accepting the fusible element; and the slots holding the element taught therebetween for insuring constant electrical resistance along a portion of the element located between the pins.

13. A fuse as defined in claim 1 wherein the body has a plurality of blow chambers; and each blow chamber providing an effective fuse electrically connected in series within the body with other blow chambers.

14. A fuse having a rated current for protecting electric or electronic circuitry comprising: a body containing a fusible element; means for defining a hot spot on the fusible element located within the body; said means for defining a hot spot having a relatively low thermal conductivity as compared with a thermal conductivity of the body for inhibiting thermal energy transfer from said hot spot to said body; the body encapsulating the hot spot and the element; a contact disposed on the body thermally conductively connected to the element and electrically connected to the element for making an electrical connection between the fuse and the circuitry; and means for sufficiently sealing said hot spot so that a pressure created by vaporization of a portion of the element within the hot spot can cause an arc initiated by fusion of the element to extinguish.

15. A fuse as defined in claim 14 wherein the fuse has a plurality of hot spots; and each hot spot acting as an effective fuse electrically connected in series within the body with other hot spots.

16. A fuse as defined in claim 14 wherein the means for defining a hot spot comprises a blow chamber.

17. A fuse as defined in claim 16 wherein a bead composed of at least one of a hot melt adhesive and wax defines the blow chamber.

18. A fuse as defined in claim 16 wherein the blow chamber comprises an air chamber.

19. A fuse having a rated current, for protecting electric or electronic circuitry, the fuse comprising: a body and a fusible element within said body; a contact disposed on the body and electrically connected to the fusible element for electrically connecting the fuse to the circuitry; the body including means for providing said body with structural strength sufficient for maintaining structural integrity of the body for retaining a pressure, sufficient for causing an arc, initiated by a predetermined voltage, to extinguish, the pressure being created within the body by vaporization of a portion of the fusible element at the predetermined voltage and an elevated current; and means for limiting a rate of thermal energy dissipation from the fusible element to a rate providing for opening of the fusible element within a predetermined time period at a predetermined elevated current being disposed at a location along the fusible element within the body.

20. A fuse as defined in claim 19 further comprising means for providing for dissipation of thermal energy from the fusible element to the contact for maintaining a thermal energy level of the fusible element and the body below a predetermined level.

21. A fuse as defined in claim 20 wherein the means for limiting a rate of thermal energy dissipation has a thermal conductivity relatively lower than a thermal conductivity of the means for providing for dissipation of thermal energy.

22. A fuse as defined in claim 19 wherein the means for limiting a rate of thermal energy dissipation comprises at least one of a blow chamber disposed in the body through which the fusible element extends, and a bead disposed on the element.

23. A fuse as defined in claim 20 wherein the means for providing for dissipation of thermal energy comprises a cement disposed about a portion of the fusible element without the means for limiting a rate of thermal energy dissipation; and the cement supplying structural strength to the body for insuring graceful failure of the fuse.

* * * * *